US009174465B2

(12) United States Patent
Moriyama et al.

(10) Patent No.: US 9,174,465 B2
(45) Date of Patent: Nov. 3, 2015

(54) PRINTER

(71) Applicant: Seiko Epson Corporation, Tokyo (JP)

(72) Inventors: Ryuji Moriyama, Matsumoto (JP); Yuichi Aruga, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/624,128

(22) Filed: Feb. 17, 2015

(65) Prior Publication Data

US 2015/0246559 A1 Sep. 3, 2015

(30) Foreign Application Priority Data

Mar. 3, 2014 (JP) ..... 2014-040163
Aug. 21, 2014 (JP) ..... 2014-168235

(51) Int. Cl.

| | |
|---|---|
| ***B41J 2/01*** | (2006.01) |
| ***B41J 11/04*** | (2006.01) |
| ***B41J 11/00*** | (2006.01) |
| *B41J 13/00* | (2006.01) |
| *B41J 17/14* | (2006.01) |
| *B41J 33/40* | (2006.01) |
| *B41J 33/51* | (2006.01) |

(52) U.S. Cl.

CPC ..... *B41J 11/04* (2013.01); *B41J 11/007* (2013.01); *B41J 13/009* (2013.01); *B41J 13/0045* (2013.01); *B41J 17/14* (2013.01); *B41J 33/40* (2013.01); *B41J 33/51* (2013.01)

(58) Field of Classification Search

CPC .... B41J 11/007; B41J 13/0045; B41J 13/009; B41J 17/14; B41J 33/40; B41J 33/51
USPC ..... 347/104, 101, 16; 271/291, 186
See application file for complete search history.

(56) References Cited

U.S. PATENT DOCUMENTS

2010/0296856 A1* 11/2010 Moriyama ..... 400/642

FOREIGN PATENT DOCUMENTS

| | | | |
|---|---|---|---|
| JP | 2003-154643 | A | 5/2003 |
| JP | 3847149 | B2 | 9/2006 |
| JP | 2013-241278 | A | 12/2013 |

* cited by examiner

*Primary Examiner* — Henok Legesse

(57) ABSTRACT

A duplex printer with a small, compact conveyance path has a medium supply path and a medium inverting path that merge into a middle conveyance path at a junction. The middle conveyance path goes to a path switching unit connecting a main conveyance path and the inverting path. A flap, which is a path switching member, is disposed in the path switching unit. A middle conveyance roller pair, having a middle conveyance roller and a nipping portion, conveys the medium (e.g. paper) through the middle conveyance path. The portion of the middle conveyance path from at least the junction to the nipping portion is a conveyance path portion defined by the roller surface of the middle conveyance roller. The paper fed to the middle conveyance path is guided by the middle conveyance roller from the junction to the nipping portion of the middle conveyance roller pair.

11 Claims, 13 Drawing Sheets

PRINTER

BACKGROUND

1. Technical Field

The present invention relates to a printer having an inverting path that reverses the front and back sides of recording paper or other sheet media and then feeds the inverted media back into the printing path.

This application is based upon Japan Patent Appl. Pub. No. 2014-040163 filed on Mar. 3, 2014, and Japan Patent Appl. Pub. No. 2014-168235 filed on Aug. 21, 2014, the entire contents of which are incorporated by reference herein.

2. Related Art

Examples of printers with an inverting path are printers with an automatic duplex print function such as described in Japan Patent 3847149 and JP-A-2013-241278. These printers have a supply path that conveys recording paper to be printed on from a supply unit, a main conveyance path passing where the recording paper is printed on, and an inverting path that reverses the front and back sides of the paper after printing on the first side. A diverter for switching the conveyance path is disposed between the upstream end of the main conveyance path and the upstream end of the inverting path. The supply path and the inverting path merge at the downstream ends thereof and then connect to where the diverter is disposed. The recording paper is guided from the supply path or the inverting path to the main conveyance path by the diverter, and the recording paper is guided to the inverting path after the first side is printed on the main conveyance path.

In the printer described in JP-A-2013-241278, a second supply roller is disposed as a conveyance roller in the supply path. The recording paper supplied from the supply unit is conveyed by the second supply roller toward the main conveyance path, and is then passed to the main conveyance roller disposed to the main conveyance path. Even recording paper that is short in the conveyance direction can be conveyed by the second supply roller.

In the printers with an inverting path as described in Japan Patent 3847149 and JP-A-2013-241278, a path switching unit comprising the diverter and the merging portion with the downstream end of the inverting path is disposed to the conveyance path between the supply unit and the print position on the main conveyance path. The length of the conveyance path from the supply unit to the print position therefore increases. A conveyance roller such as described in JP-A-2013-241278 may also be required to print on short recording paper. Making a printer with an inverting path such as described above small and compact is therefore difficult because the conveyance path is long and a conveyance roller for conveying short recording paper is required.

Because the supply path and the inverting path merge together, there can be a difference in elevation or a discontinuity between the conveyance guide surfaces of the conveyance paths where they merge. The recording paper can therefore easily jam where the conveyance paths merge. More specifically, because the leading end part of the recording paper can easily curl after printing on the first side, the recording paper may jam where the conveyance paths merge after printing the first side. Problems such as deviation in the conveyance precision of the recording paper where the paths merge can also result from the difference in elevation or discontinuity between the conveyance guide surfaces.

SUMMARY

An objective of the present invention is to provide a printer having a small, compact medium conveyance path. Another objective of the present invention is to provide a printer that can convey media with good precision both before and after printing. A further objective of the invention is to provide a printer that can prevent or suppress the occurrence of paper jams where conveyance paths merge.

To solve the foregoing problem, a printer according to one aspect of the invention has a media supply path that conveys a medium to be printed upon; a first conveyance path that conveys the medium past a print position, the direction of conveying the medium to the printing position for printing being the downstream direction of the first conveyance path; a looped inverting path that reverses the front and back sides of the medium; a junction where the downstream end of the media supply path and the downstream end of the inverting path merge; a second conveyance path extending from the junction to a path switching unit where the upstream end of the first conveyance path and the upstream end of the inverting path merge; and a conveyance roller pair that conveys the medium from the junction toward the path switching unit. The conveyance roller pair preferably include a drive roller and a nipping portion. The medium is guided by a conveyance roller from the junction to the media nipping portion of the conveyance roller pair. The conveyance roller is preferably the drive roller of the conveyance roller pair.

Thus comprised, the medium is guided by the conveyance roller of the conveyance roller pair from the junction to the media nipping portion of the conveyance roller pair. The conveyance distance from the junction to the media nipping portion can therefore be shortened, and media that has been printed on one side and is fed from the inverting path to the junction can be quickly nipped by the conveyance roller pair. As a result, media that is fed to the junction can be prevented or suppressed from jamming at the junction. Furthermore, because the conveyance roller guides the medium, conveyance force is applied by the conveyance roller to the medium. Media fed into the junction can therefore be conveyed with good precision. Furthermore, because the conveyance roller for conveying the medium is also used as a member for guiding the medium, the parts count can be suppressed and the second conveyance path can be compactly configured.

Preferably, the conveyance roller and a media guide opposite the conveyance roller guide the medium along the media supply path to the junction from a position a specific distance upstream from the junction on the media supply path.

Thus comprised, the conveyance roller can also be used as a media guide surface on the media supply path. The media supply path can therefore be configured compactly with few parts.

Yet further preferably, the media guide has a media pressure surface that presses the medium toward the conveyance roller.

Thus comprised, media conveyed along the media supply unit is pushed against the conveyance roller by the media pressure surface, and is conveyed to the downstream side by rotation of the conveyance roller. The media can therefore be conveyed with good precision through the media supply path.

In a printer according to another aspect of the invention, the upstream end of the first conveyance path has a conveyance guide surface that faces the conveyance roller and guides media conveyed by the conveyance roller pair. The conveyance roller has an outside roller surface that rotates away from the conveyance guide surface in the downstream direction of the first conveyance path. The path switching unit preferably includes a path switching member (e.g. switching flap) having a first member surface on a side facing away from the conveyance roller and a second member surface opposite the first member surface on a side facing the conveyance roller. A first switching-member guide surface is formed on the first member surface, and a second switching-member guide surface is formed on the second member surface. The path switching member is movably switchable between a first switching position and a second switching position. The first switching position guides media, that is conveyed from the first conveyance path to the path switching unit, to the inverting path. The second switching position guides media (that is conveyed from the second conveyance path to the path switching unit) to the first conveyance path. The path switching member is biased toward the first switching position in a resting state and requires a pushing force to be moved to the second switching position. In the first switching position, the second switching-member guide surface is proximate to the conveyance roller, and the distal end of the second switching-member guide surface (that is closest to the first conveyance path) facing the outside roller surface of the conveyance roller. When medium is conveyed to the path switching unit by the conveyance roller pair, the medium pushes on the second switching-member guide surface and pushes the path switching member to the second switching position. In the second switching position, the second switching-member guide surface is moved away from the conveyance roller, and the distal end of the first switching-member guide surface (that is closest to the first conveyance path) is at a position moved away from the conveyance guide surface of the first conveyance path.

Thus comprised, media fed from the junction to the path switching unit is conveyed along the conveyance roller and contacts the second guide surface of the switching member, moves while pushed the switching member up to the second switching position, and is guided along the second guide surface to the first conveyance path. At this point, the second guide surface distal end portion on the first conveyance path side of the second guide surface is at an opposing position facing the outside surface of the conveyance roller. The area of the medium that is conveyed pressed to the surface of the roller by the second guide surface distal end portion is therefore large. The medium is therefore conveyed with good precision by the conveyance roller. In addition, the medium conveyed from the first conveyance path to the path switching unit is fed to the inverting path guided by the first guide surface of the switching member at the first switching position. The first guide surface distal end portion on the first conveyance path side of the first guide surface at this point is lower than the conveyance guide surface that guides the medium at the upstream end part of the first conveyance path. The medium therefore moves smoothly without jamming when moving from the first conveyance path to the first guide surface. Media that has been printed on one side can therefore be prevented or suppressed from jamming at the path switching unit.

Further preferably as shown in FIG. 6, the first distal end of the first switching-member guide surface (that is closest to the first conveyance path) is an upstream end-side first guide surface. The second distal end of the first switching-member guide surface opposite the upstream end-side first guide surface is a downstream end-side first guide surface. The portion of the first switching-member guide surface between the upstream end-side first guide surface and the downstream end-side first guide surface is a middle first guide surface. Preferably in the first switching position: the upstream end-side first guide surface is defined by a downward sloping plane that slopes from the middle first guide surface toward conveyance roller; the downstream end-side first guide surface is defined by a substantially horizontal plane that extends in a feed direction of medium conveyed from the first conveyance path toward the inverting path; and the middle first guide surface defined by a curve smoothly connecting the upstream end-side first guide surface to the downstream end-side first guide surface.

Thus comprised, the upstream side first guide surface functions as a surface that guides media conveyed from the first conveyance path. The media can therefore be prevented or suppressed from jamming between the first conveyance path and the switching member. Media on the upstream side first guide surface is also guided from the upstream side first guide surface along the middle first guide surface to the downstream side first guide surface, and is fed smoothly along the downstream side first guide surface to the inverting path.

Further preferably, media conveyed through the media nipping portion to the path switching unit contacts a flat part of the second switching-member guide surface.

Thus comprised, the leading end of the medium conveyed from the second conveyance path to the path switching unit contacts the guide surface part of the switching member. Because the guide surface part is flat, the contact angle with the medium does not change greatly even when the point of contact with the medium changes compared with when the guide surface is defined by a curve, for example. There is, therefore, no great change in the force of the medium pushing up on the switching member, and the position of the switching member can be changed smoothly. In other words, because change in the conveyance resistance acting on the medium from the switching member side can be suppressed, the medium can be conveyed with good precision.

Further preferably, the switching member includes a plurality of ribs extending in a first feed direction of medium conveyed from the first conveyance path toward the inverting path. The plurality of ribs are disposed at regular intervals widthwise relative to the first feed direction. The switching member further includes connector parts connecting the ribs widthwise. Preferably, a top edge of each rib is a respective one of the first member surface, and a bottom edge of each rib is a respective one of the second member surface.

Thus comprised, the contact area of medium with the first and second guide surfaces of the switching member can be reduced, and the conveyance resistance of the medium can be reduced. Furthermore, media conveyance problems, for example, due to the medium sticking to the first and second guide surfaces of the switching member due to static electricity can be prevented or suppressed.

Further preferably, when the conveyance roller has a roller shaft, and a plurality of roller segments are disposed with a specific gap therebetween on the roller shaft, the ribs are disposed widthwise relative to the conveyance path on both sides of the roller segments.

More specifically, media fed from the second conveyance path to the path switching unit pushes the switching member up against the weight or urging force holding the switching member in the first switching position. The ribs of the switching member are located on both sides of the roller segments of the conveyance roller. All parts of the medium are therefore reliably pushed toward the outside of the roller segments by the second guide surfaces of the ribs on both sides of the roller segments. As a result, the medium is reliably pressed at all parts across the width to the outside surface of each roller segment in the conveyance roller, and the medium can therefore be reliably conveyed by the conveyance roller.

Further preferably, the printer also has a media separation mechanism that separates and conveys the media one sheet at a time through the media supply path, and the media separation mechanism includes the conveyance roller, and a retard roller that can contact the conveyance roller.

Thus comprised, the conveyance roller can also be used as a component of the media separation mechanism. The parts count of the media separation mechanism can therefore be reduced, and the media separation mechanism can be compactly configured.

A printer according to another aspect of the invention also has a main conveyance roller pair that conveys the medium through the first conveyance path; a power supply that rotationally drives the main conveyance roller pair; and a power transfer mechanism that transfers drive power from the power supply to the conveyance roller to rotationally drive the conveyance roller in the direction conveying the medium to the path switching unit.

Thus comprised, because the power supply can be used for both the main conveyance roller pair and the conveyance roller pair, the parts count can be reduced and the printer can be compactly configured.

Optionally, the above-recited path switching member may be a flap freely pivotal about a pivot point. In this case, the first switching position may be the resting state of the flap, and the flap is biased toward the first switching position by gravity. Also, the second switching position may be a displacement position of the flap when pivoted against gravity about the pivot point.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer capable of duplex printing and having an inverting path according to the present invention is described below with reference to the accompanying figures.

Printer Configuration

Figure 1:
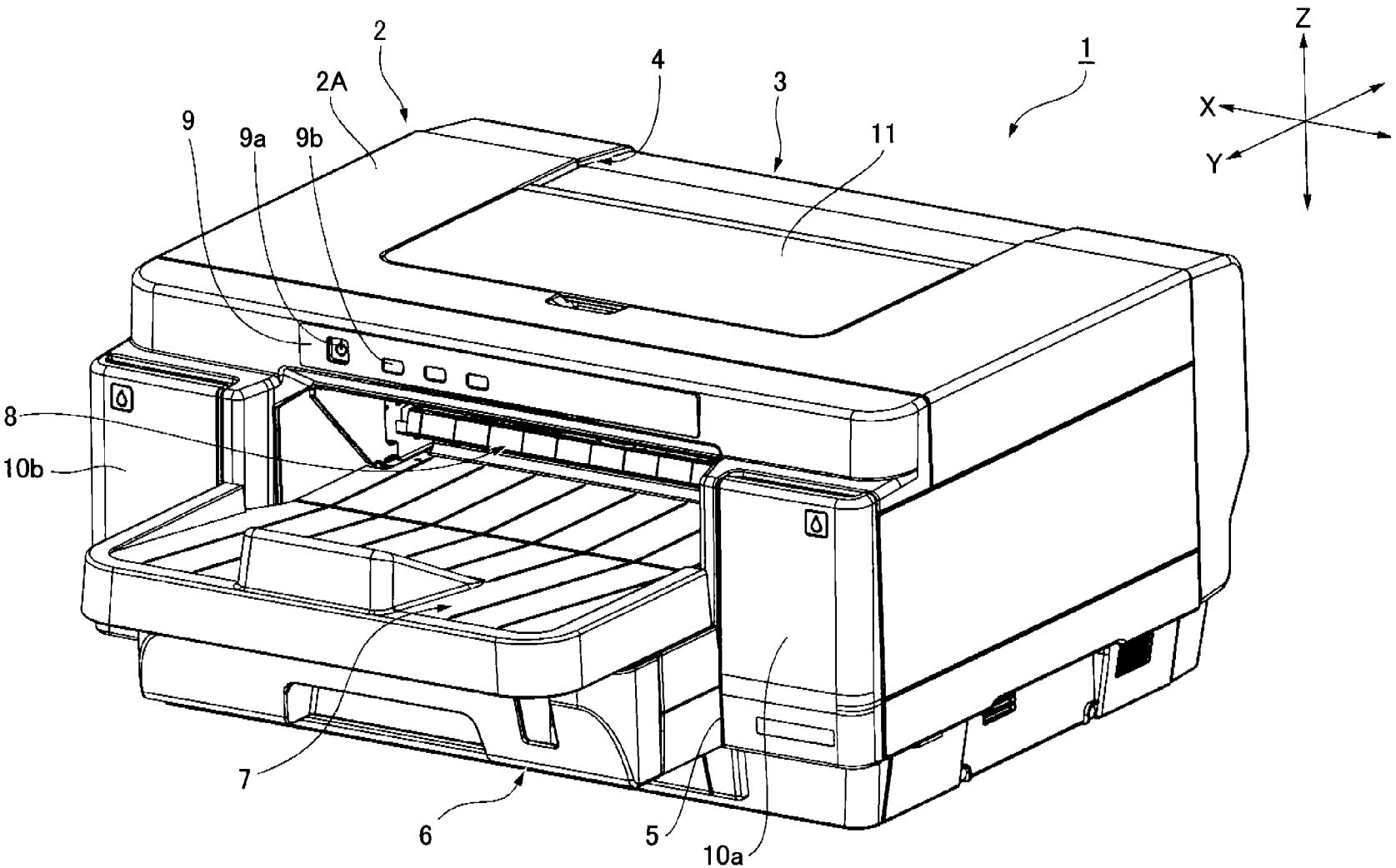
FIG. 1 is an oblique view from the front of a printer according to an embodiment of the invention.
Figure 2:
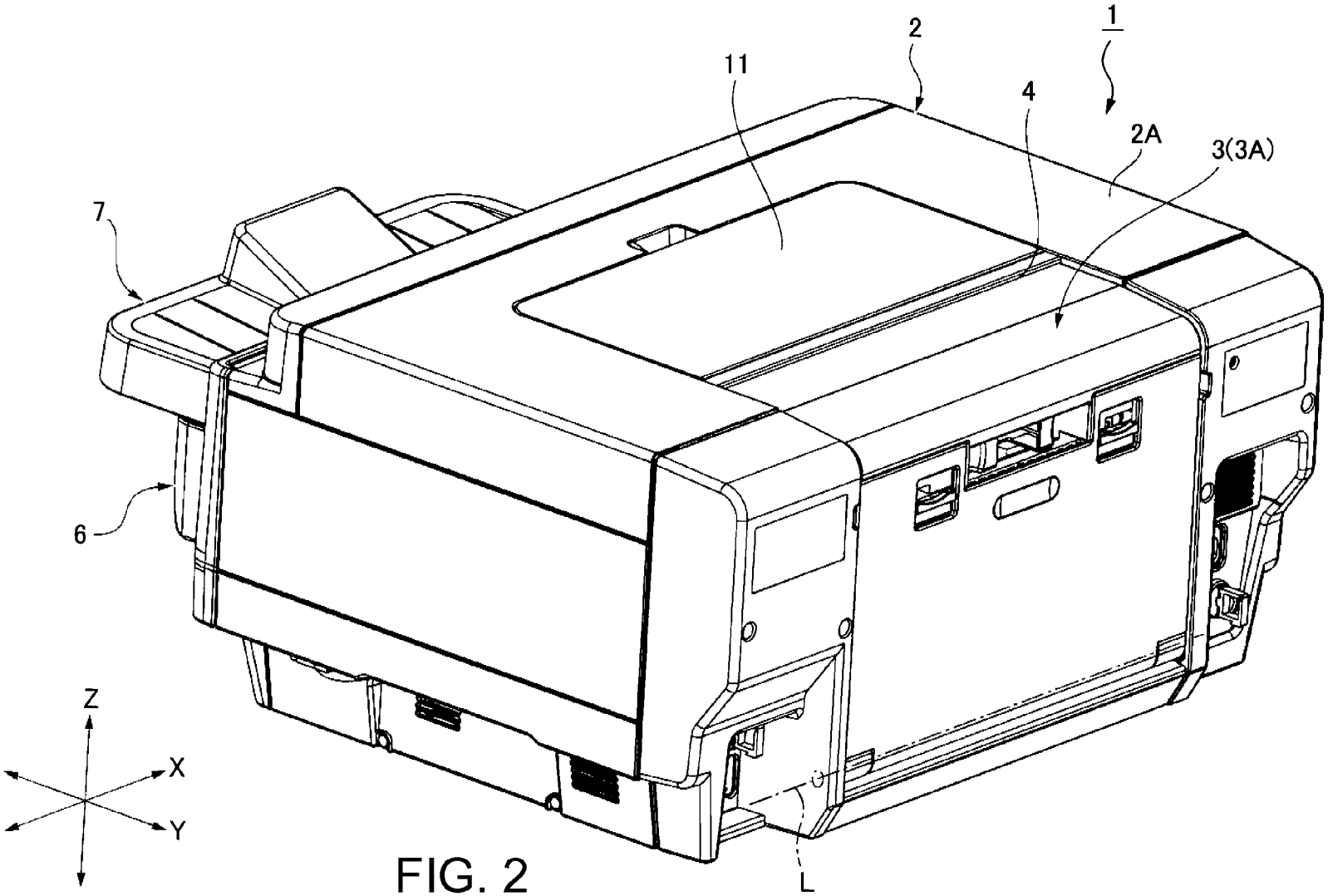
FIG. 2 is an oblique view from the back of the printer with the inverting unit closed.
Figure 3:
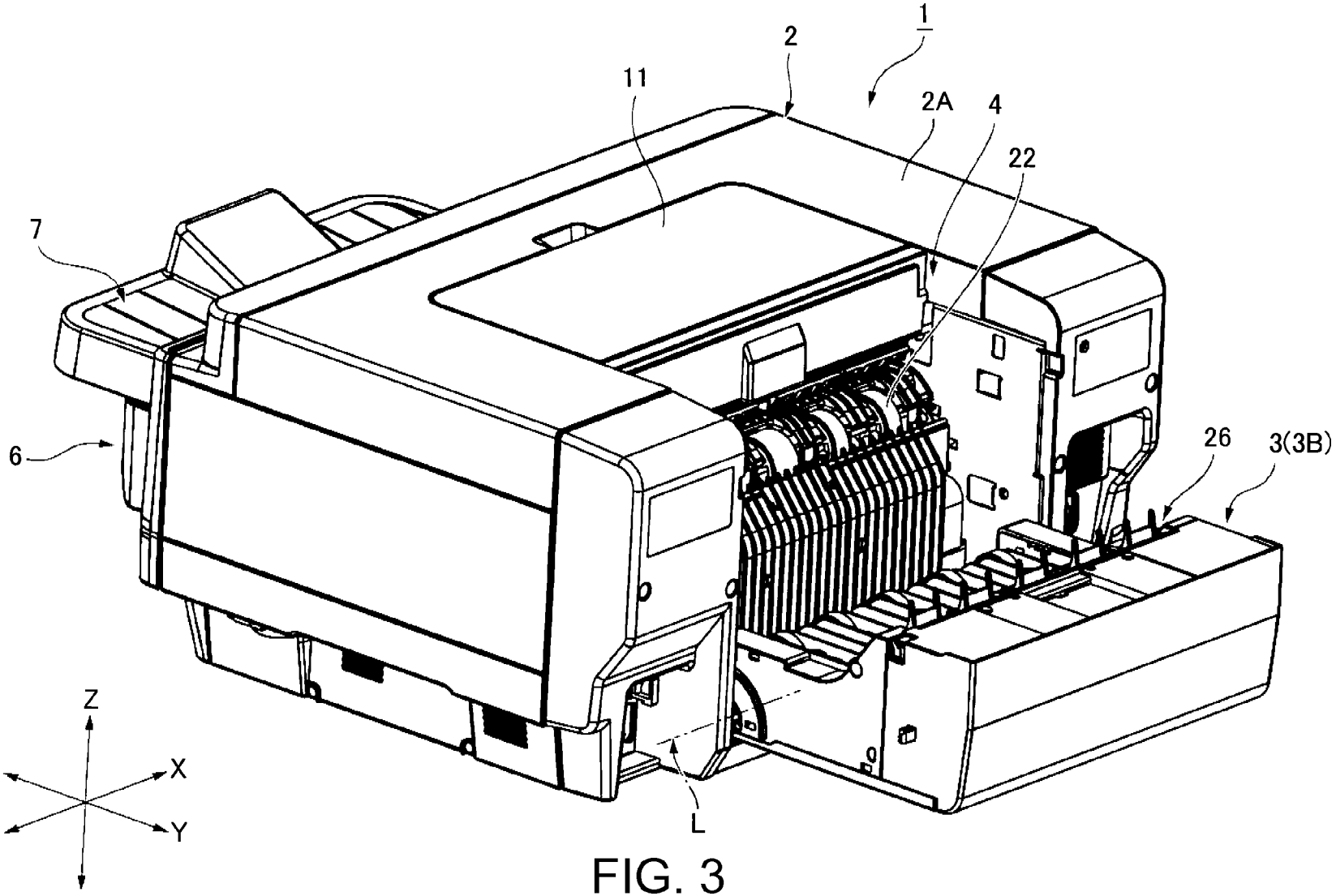
FIG. 3 is an oblique view from the back of the printer with the inverting unit open.

FIG. 1 is an oblique view from the front of an inkjet printer (referred to below as simply a printer) according to a preferred embodiment of the invention, and FIG. 2 and FIG. 3 are oblique views of the same print from the back.

The general configuration of the printer 1 is described below with reference to FIG. 1 and FIG. 2. The printer 1 has a main unit 2 and an inverting unit 3 housed in a printer case 2A. The main unit 2 has a basically rectangular box-like shape that is long on the transverse axis X widthwise to the printer, has a recess 4 towards the front of the printer formed in the middle of the back, and has an inverting unit 3 installed in this recess 4. The inverting unit 3 is a unit for inverting the front and back sides of the printing paper P (simply "paper" below), which is a form of sheet media, and then returning the inverted paper into the main unit 2.

As will be understood from FIG. 2 and FIG. 3, the inverting unit 3 can open and close on a pivot axis L at the bottom on the vertical axis Z of the printer. When in the closed position 3A shown in FIG. 2, the inverting unit 3 is upright along the vertical axis Z, and the back of the inverting unit 3 is substantially flush with the back left and right surfaces of the main unit 2. When in the open position 3B shown in FIG. 3, the inverting unit 3 is dropped to a substantially horizontal position to the back along the longitudinal axis Y. As will be understood from FIG. 3, part of the inverting conveyance path 14 (see FIG. 4) described below is open (e.g. exposed) when the inverting unit 3 is in the open position 3B. Problems such as paper jams in this conveyance paths can therefore be easily corrected by opening the inverting unit 3.

As will be understood from FIG. 1, a paper cassette loading unit 5 is disposed toward the front of the main unit 2. The paper cassette loading unit 5 opens to the front on the longitudinal axis Y at a position toward the bottom on the vertical axis Z at the front of the main unit 2. A paper cassette 6 can be loaded from the front into the paper cassette loading unit 5. A media supply unit is embodied by the paper cassette loading unit 5 and paper cassette 6.

A paper discharge tray 7 is attached above the paper cassette loading unit 5. The paper discharge tray 7 protrudes horizontally toward the front. A rectangular paper exit 8 extending from the front toward the back of the printer is formed above the paper discharge tray 7.

An operating panel 9 is at the front of the printer above the paper exit 8. The operating panel 9 includes a power switch 9*a* and a plurality of status indicators 9*b*. Rectangular access doors 10*a*, 10*b* are attached at the front of the printer on opposite sides of the paper discharge tray 7 and paper exit 8. When the access doors 10*a*, 10*b* are open, the ink cartridge loading unit (not shown in the figure) is open and ink cartridges (not shown in the figure) can be installed. The top of the printer is substantially flat, and an access cover 11 is attached in the middle.

Internal Configuration of the Printer

Figure 4:
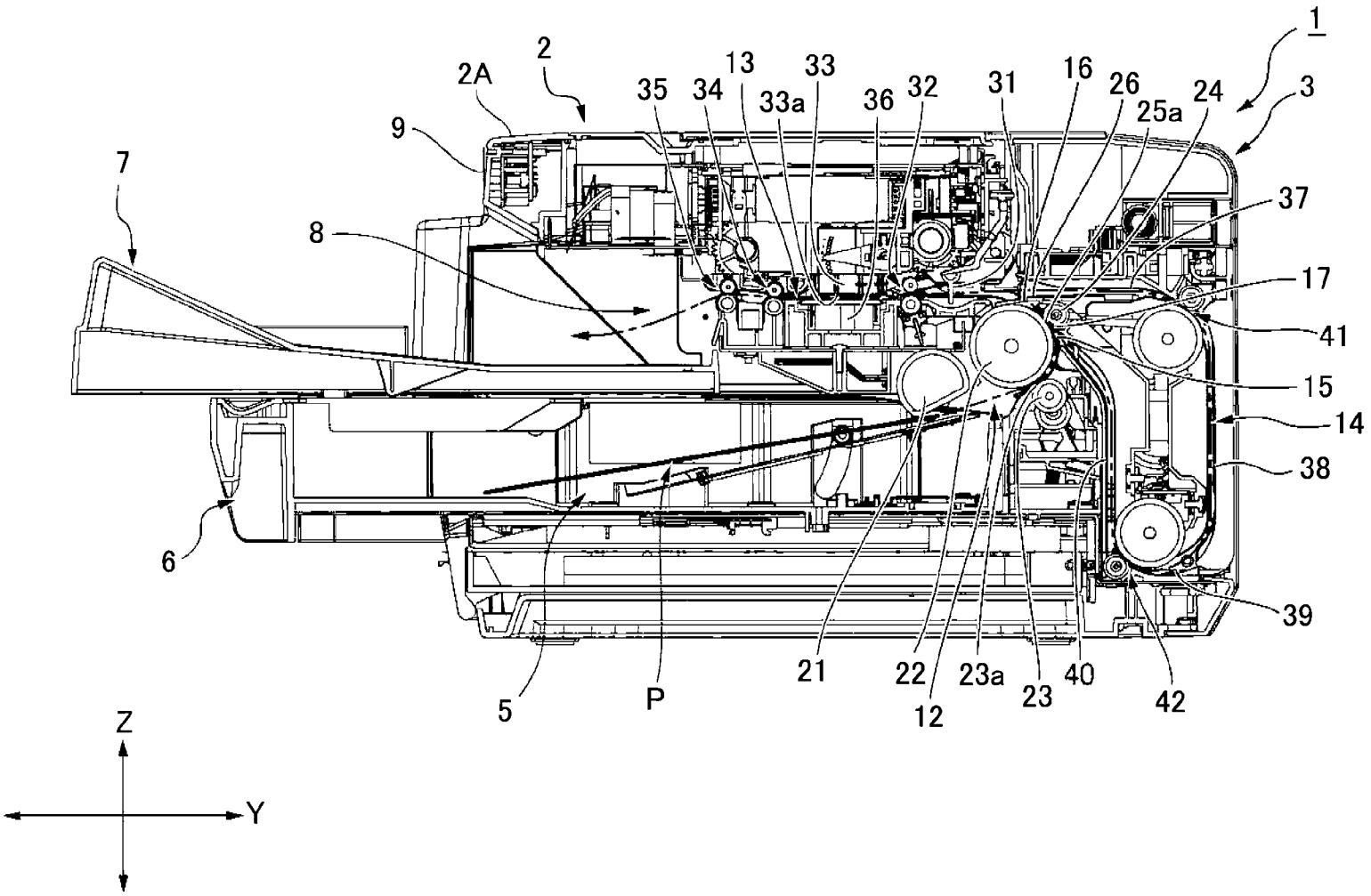
FIG. 4 is a side section view of the printer.
Figure 5:
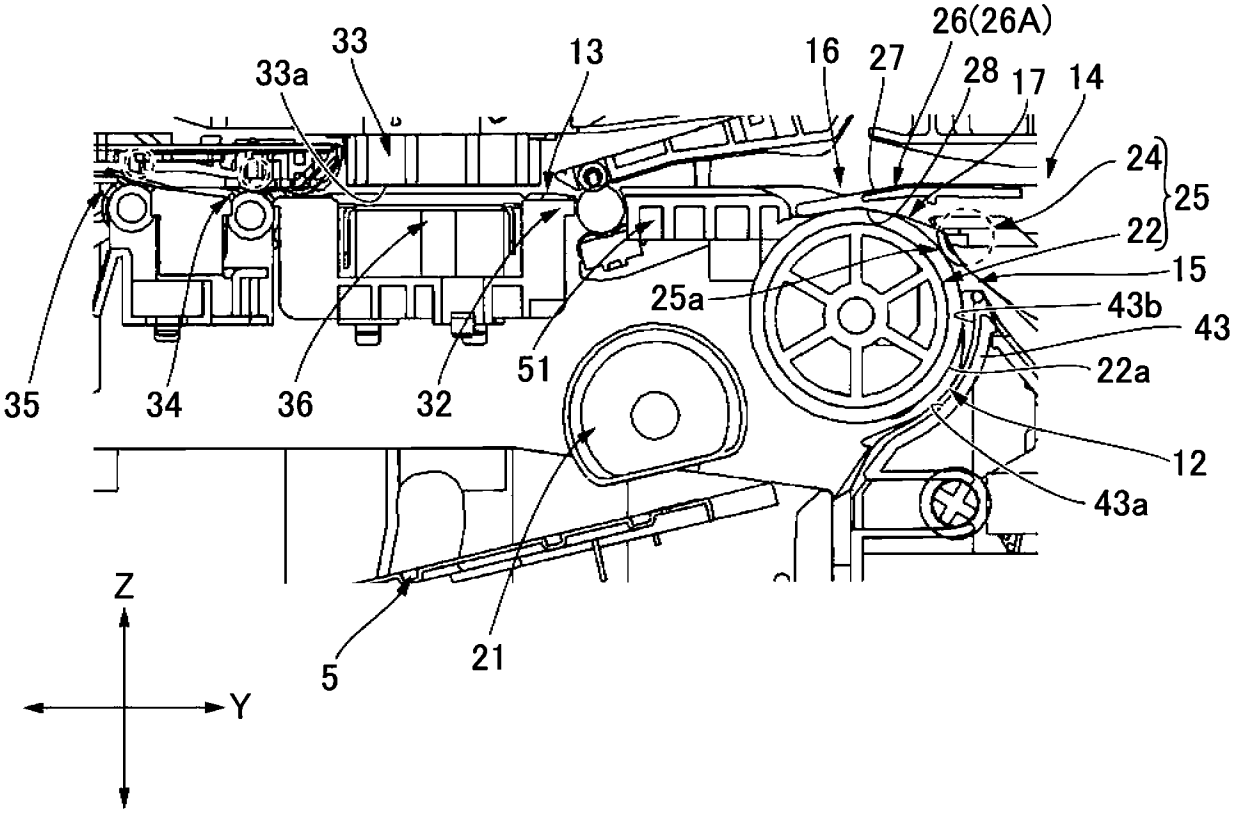
FIG. 5 is an enlarged view of part of the conveyance path of the printer.
Figure 6A:
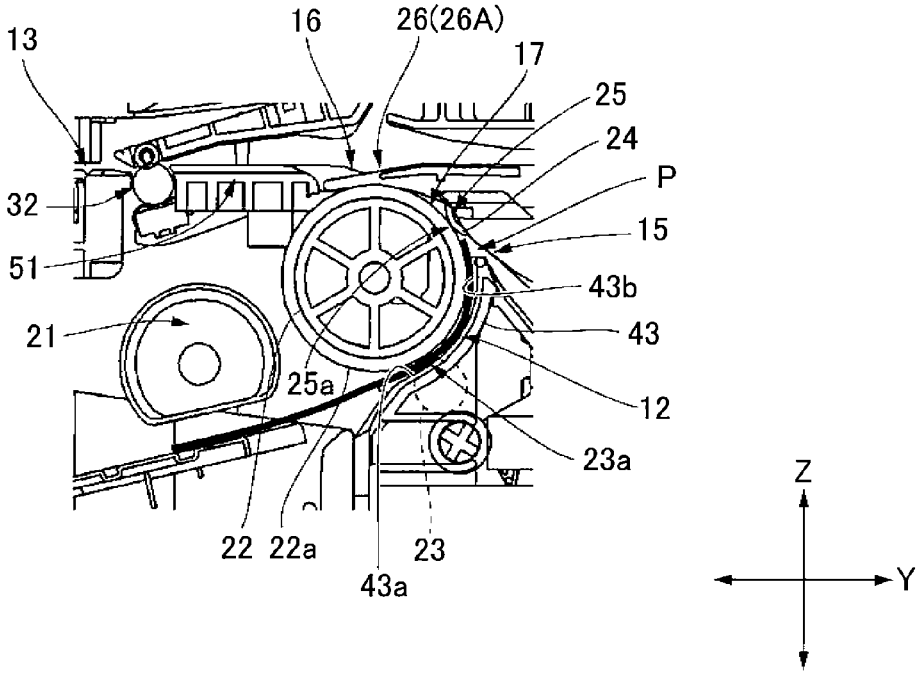
FIG. 6A illustrates a first detailed view of printing paper being conveyed from the supply path to the middle conveyance path.
Figure 6B:
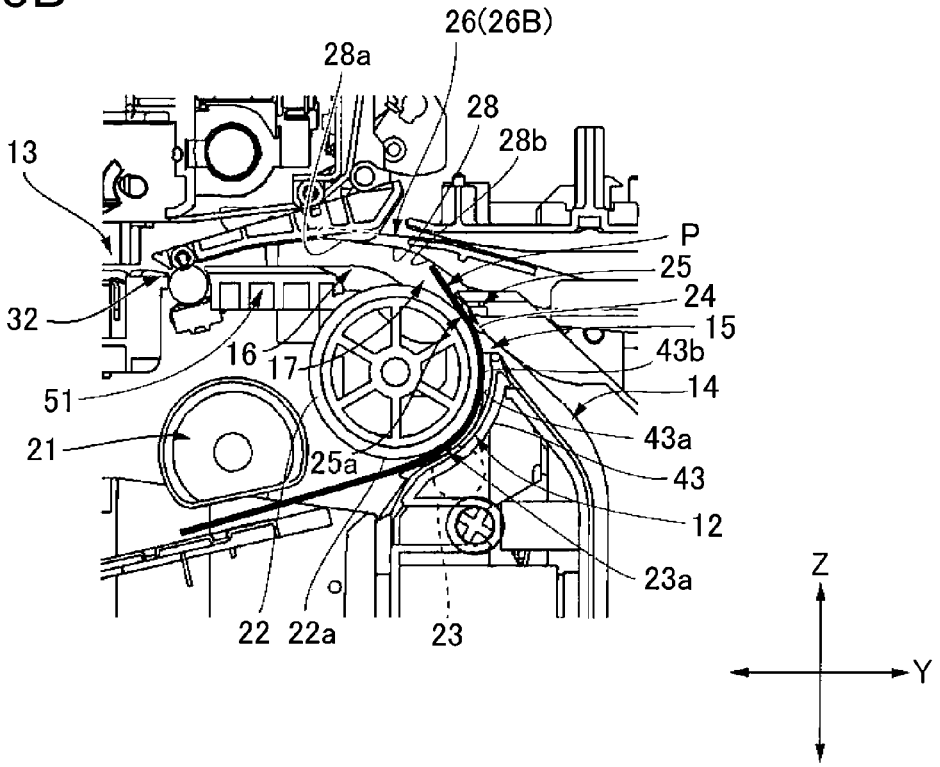
FIG. 6B illustrates a second detailed view of printing paper being conveyed from the supply path to the middle conveyance path.
Figure 7:
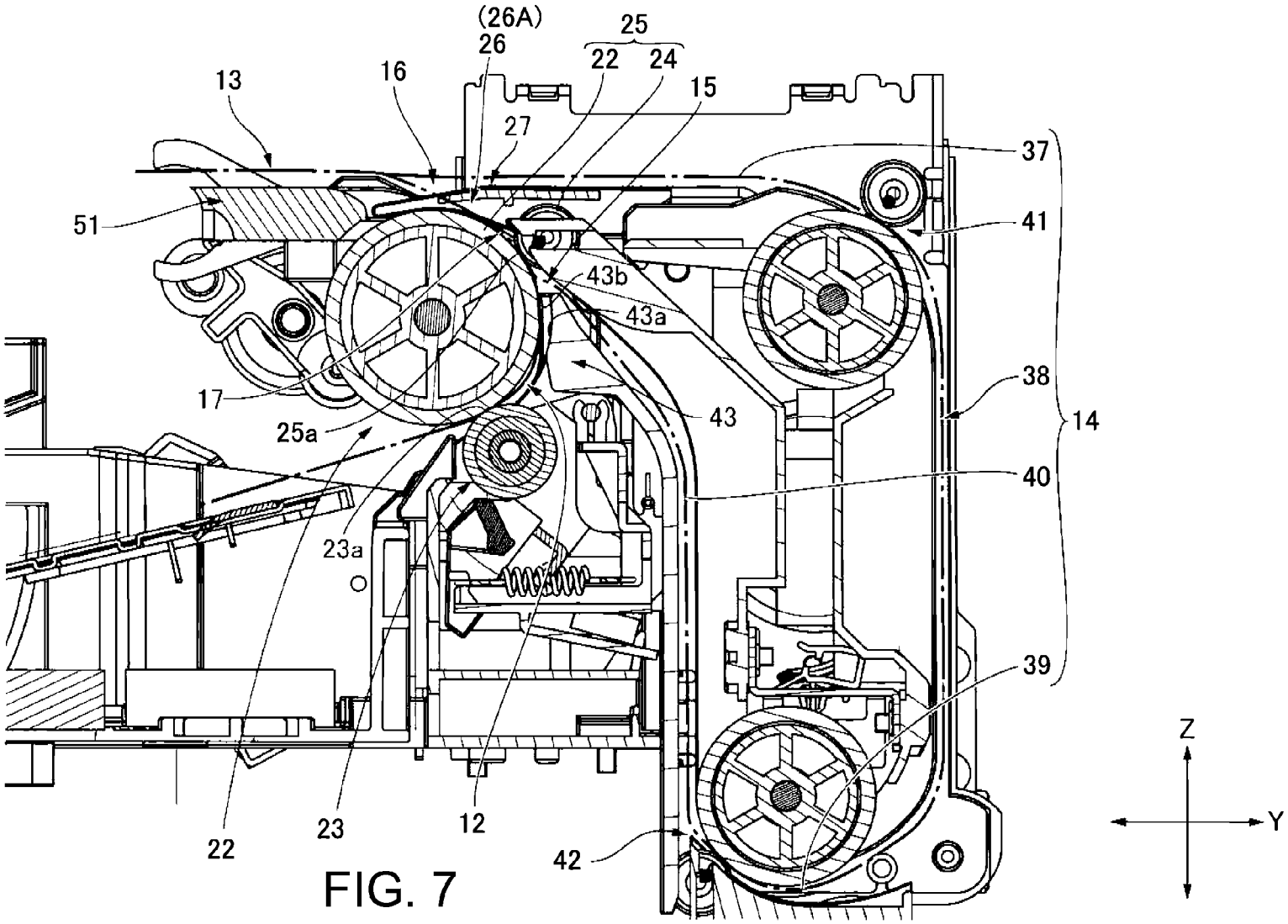
FIG. 7 is an enlarged section view of the conveyance path in the printer.

FIG. 4 is a side section view showing the internal configuration of the printer 1, and FIG. 5 is a section view of part of the conveyance path formed inside the printer. FIGS. 6A and 6B illustrate the paper P being conveyed from the supply path to the middle conveyance path. FIG. 7 is a section view of part of the conveyance path formed inside the printer 1, showing particularly the area around the middle conveyance roller and retard roller. FIG. 8 illustrates the paper P being conveyed from the inverting path to the middle conveyance path.

As described below with reference to the figures, a supply path 12 that conveys paper P supplied from the paper cassette 6, a main conveyance path 13 (first conveyance path) that conveys the paper P past the print position, and an inverting path 14 formed in a loop that reverses the front and back sides of the paper P, are formed inside the printer 1. The downstream end in the supply direction of the supply path 12, and the downstream end in the paper conveyance direction of the inverting path 14, merge at a junction 15. A path switching unit 16 is formed at a junction where the upstream end (i.e. starting point) of the main conveyance path 13 and the upstream end (i.e. starting point) of the inverting path 14 connect (e.g. meet). The junction 15 and the path switching unit 16 are connected by a middle conveyance path 17 (second conveyance path). A flap 26 (e.g. flap-style path diverter), which is the path switching member described below, is disposed in the path switching unit 16.

The supply path 12 is the conveyance path that supplies paper P of a specific size stored in a stack in the paper cassette 6 to the main conveyance path 13. The supply path 12 extends diagonally upward toward the back of the printer from the back end of the paper cassette loading unit 5 on the longitudinal axis Y, and connects to the junction 15 with the inverting path 14. The paper P stored in the paper cassette 6 is fed by a supply roller 21 to the supply path 12.

The paper P delivered to the supply path 12 is conveyed one sheet at a time through a nipping portion 23*a* of the middle conveyance roller 22 (conveyance roller) and the retard roller 23. More specifically, the middle conveyance roller 22 and the retard roller 23 form a media separation mechanism. The paper P is guided from the nipping portion 23*a* of the supply path 12 to the junction 15 by the middle conveyance roller 22 and a paper guide 43 (media guide) opposite the middle conveyance roller 22 with a narrow gap therebetween.

The paper guide surface 43*a* of the paper guide 43 is a conveyance guide surface opposite the roller surface 22*a* of the middle conveyance roller 22 along the supply path 12, and is a curved concave surface shaped substantially the same as the roller surface 22*a*. A paper pressure surface 43*b* (media pressure surface) pushing gradually toward the roller surface 22*a* in the paper conveyance direction is formed to the paper guide surface 43*a* from the junction 15 to a position a specific distance on the upstream side. The paper pressure surface 43*b* is a surface with ribs formed at a specific interval across the width of the supply path 12 (the transverse axis X).

Paper P that has passed through the nipping portion 23*a* of the middle conveyance roller 22 and retard roller 23 is therefore conveyed while pushed gradually toward the roller surface 22*a* by the paper pressure surface 43*b* of the paper guide 43. As a result, as shown in FIG. 6A, the paper P fed to the middle conveyance path 17 is guided by the middle conveyance roller 22 from the junction 15 to another nipping portion 25*a* (media nipping portion) of a middle conveyance roller pair 25 (conveyance roller pair) comprised of the middle conveyance roller 22 and a driven roller 24. The paper P is also conveyed in contact with the roller surface 22*a* to the middle conveyance path 17. The paper P can therefore be conveyed with good precision by the middle conveyance roller 22 to the junction 15.

The paper P is then nipped by the middle conveyance roller pair 25 and fed toward the path switching unit 16.

As shown in FIG. 4 to FIG. 8, the flap 26 is disposed in the path switching unit 16 (e.g. flap 26 is part of the path switching unit 16). As shown in FIG. 6A, the flap 26 can move between a first switching position 26A near the roller surface 22*a* of the middle conveyance roller 22, and a second switching position 26B (shown in FIG. 6B) away from the roller surface 22*a*. In this example, the flap 26 is held by its own weight at the first switching position 26A (i.e. its resting position is the first switching position). The flap 26 is attached at the inverting unit 3 side so that the flap 26 can be pushed up from the first switching position 26A to the second switching position 26B by the leading end of the paper P conveyed by the middle conveyance roller pair 25 toward the path switching unit 16. The paper P conveyed by the middle conveyance roller pair 25 to the path switching unit 16 is therefore conveyed to the upstream end of the main conveyance path 13 along a second guide surface 28, which is the back side of the flap 26 (the side facing the roller surface 22*a*), while pushing the flap 26 up to the second switching position 26B.

As will be understood from FIG. 4, the main conveyance path 13 is the conveyance path portion extending substantially horizontally on the longitudinal axis Y. Disposed to the main conveyance path 13 sequentially from the upstream side in the paper conveyance direction are a paper detection lever 31, a main conveyance roller pair 32, a printhead 33, and a first discharge roller pair 34 and second discharge roller pair 35, which are pairs of discharge rollers. The printhead 33 is an inkjet head with the nozzle face 33*a* facing down. A platen 36 is disposed opposite the nozzle face 33*a* with a specific gap therebetween.

The paper P directed into the main conveyance path 13 while pushing the flap 26 of the path switching unit 16 up is fed to the nipping portion of the main conveyance roller pair 32. When the trailing end of the paper P in the conveyance direction separates from the flap 26, the flap 26 descends of its own weight to the first switching position 26A again. The paper P fed to the nipping portion of the main conveyance roller pair 32 is conveyed past the print position of the printhead 33 by the main conveyance roller pair 32, and is fed toward the first discharge roller pair 34. The paper P nipped by the first discharge roller pair 34 then passes between the first discharge roller pair 34 and second discharge roller pair 35, and is discharged from the paper exit 8 to the paper discharge tray 7.

As shown in FIG. 4 and FIG. 7, the inverting path 14 formed inside the inverting unit 3 is behind the main conveyance path 13 on the longitudinal axis Y and below it on the vertical axis Z, and is a conveyance path that forms a loop on the vertical axis Z. The inverting path 14 includes a top path 37 that extends substantially horizontally toward the back of the printer along the longitudinal axis Y from the path switching unit 16 communicating with the upstream end of the main conveyance path 13. The inverting path 14 also includes a descending path 38 that curves downwards from top path 37 and then extends straight down along the vertical axis Z. The inverting path 14 additionally includes a bottom path 39 that extends from the bottom of descending path 38 and curves toward the front of the printer along the longitudinal axis Y. The inverting path 14 further includes an ascending path 40 that curves and extends upwards from the bottom path 39. The top part of the ascending path 40 curves at an angle toward the front of the printer, and the downstream end of the ascending path 40 merges with the downstream end of the supply path 12 at the junction 15.

A first conveyance roller pair 41 is disposed between the top path 37 and the descending path 38, and a second conveyance roller pair 42 is disposed between the bottom path 39 and the ascending path 40. Paper P conveyed by the main conveyance roller pair 32 through the main conveyance path 13 in the reverse direction toward the back of the printer is guided to the inverting path 14 along a first guide surface 27 (see FIG. 7), which is a surface of the flap 26 (the surface facing away from the roller surface 22*a*) held at the first switching position 26A as shown in FIG. 5 and FIG. 7.

The paper P fed into the inverting path 14 is conveyed to the nipping part of the first conveyance roller pair 41, conveyed by the first conveyance roller pair 41 through the top path 37 and descending path 38, and directed to the nipping part of the second conveyance roller pair 42. The paper P directed to the nipping part of the second conveyance roller pair 42 is conveyed by the second conveyance roller pair 42 through the bottom path 39 and ascending path 40 to the junction 15. The paper P is then conveyed through the junction 15 to the nipping portion 25*a* of the middle conveyance roller pair 25, and then conveyed by the middle conveyance roller pair 25 through the middle conveyance path 17 to the path switching unit 16.

Figure 8A:
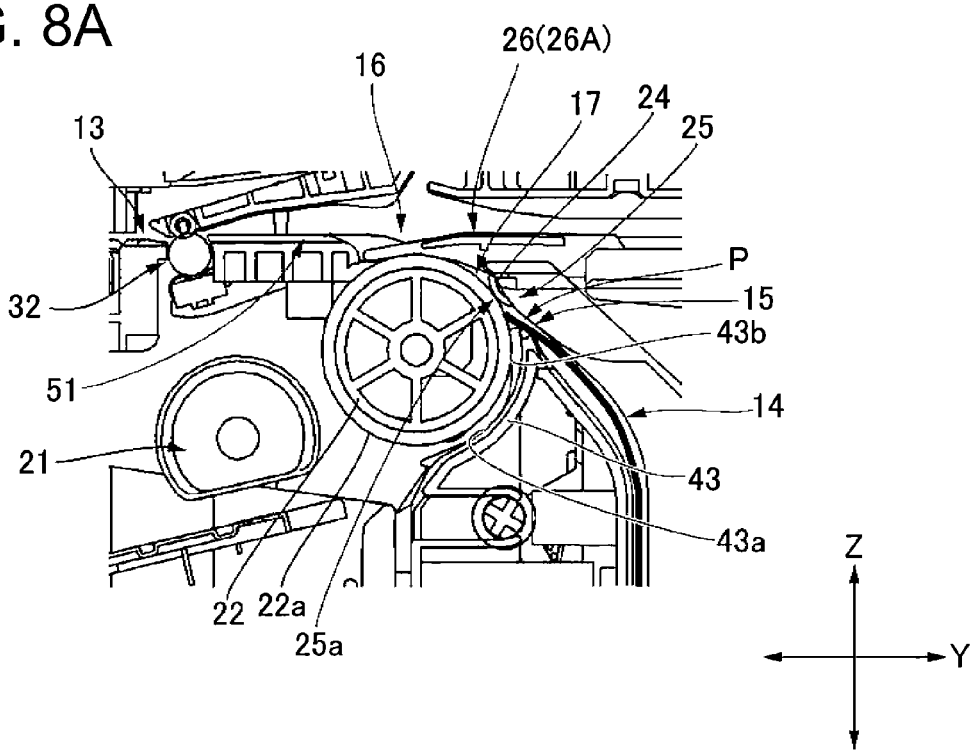
FIG. 8A illustrates a first detailed view of printing paper being conveyed from the inverting path to the middle conveyance path.

As shown in FIG. 8A, the paper P fed from the inverting path 14 to the middle conveyance path 17 is guided by the middle conveyance roller 22 from the junction 15 to the nipping portion 25*a* of the middle conveyance roller pair 25. The conveyance distance of from the junction 15 to the nipping portion 25*a* is therefore short, and media printed on one side and fed from the inverting path 14 to the junction 15 can be nipped by the middle conveyance roller pair 25. As a result, the possibility of paper P becoming jammed at junction 15 as it is fed from inverting path 14 to the junction 15 can be prevented or suppressed. Furthermore, because the middle conveyance roller 22 guides the paper P, conveyance force is applied to the paper P by the middle conveyance roller 22. The paper P directed to the junction 15 can therefore be conveyed with good precision.

Figure 8B:
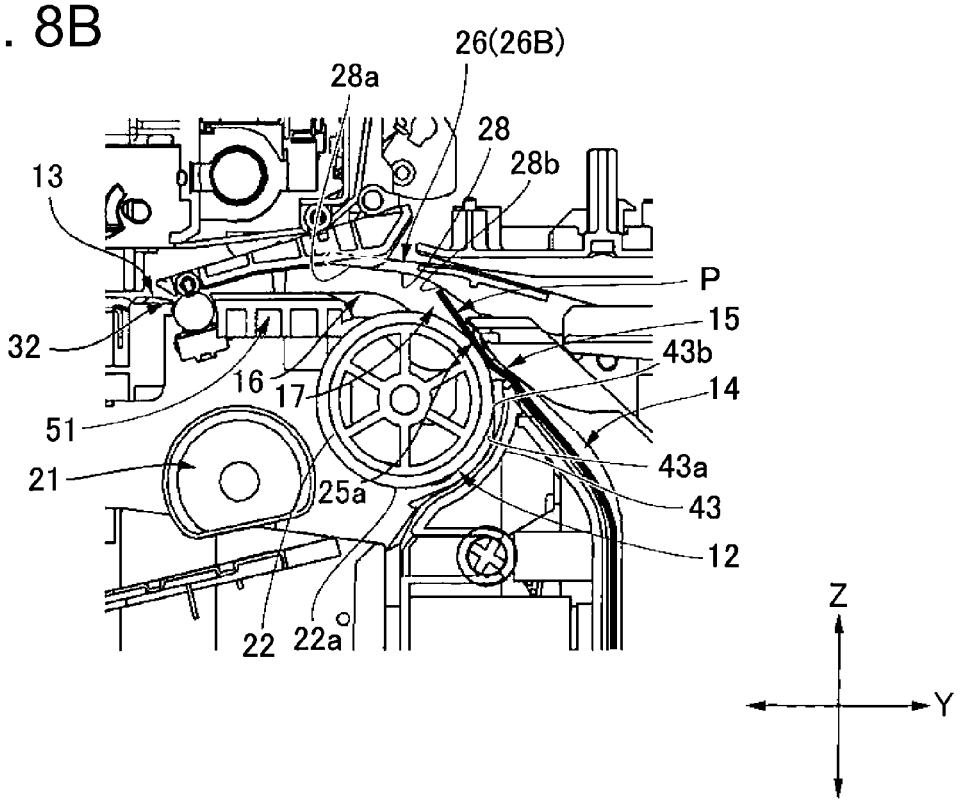
FIG. 8B illustrates a first detailed view of printing paper being conveyed from the inverting path to the middle conveyance path.

The paper P conveyed through the nipping portion 25*a* of the middle conveyance roller pair 25 is fed to the path switching unit 16. As shown in FIG. 8B, the paper P is fed to the upstream end of the main conveyance path 13 along the second guide surface 28, which is the back side (the side facing the roller surface 22*a*) of the flap 26, while pushing the flap 26 up to the second switching position 26B.

By passing through the looped inverting path 14, the paper P is returned to the main conveyance path 13 with the front and back sides of the paper P reversed. The back (second) side of the paper P can then be printed by the printhead 33 by conveying the inverted paper P through the main conveyance path 13 past the print position. The paper P can therefore be printed on both sides bypassing through the inverting path 14.

Figure 9:
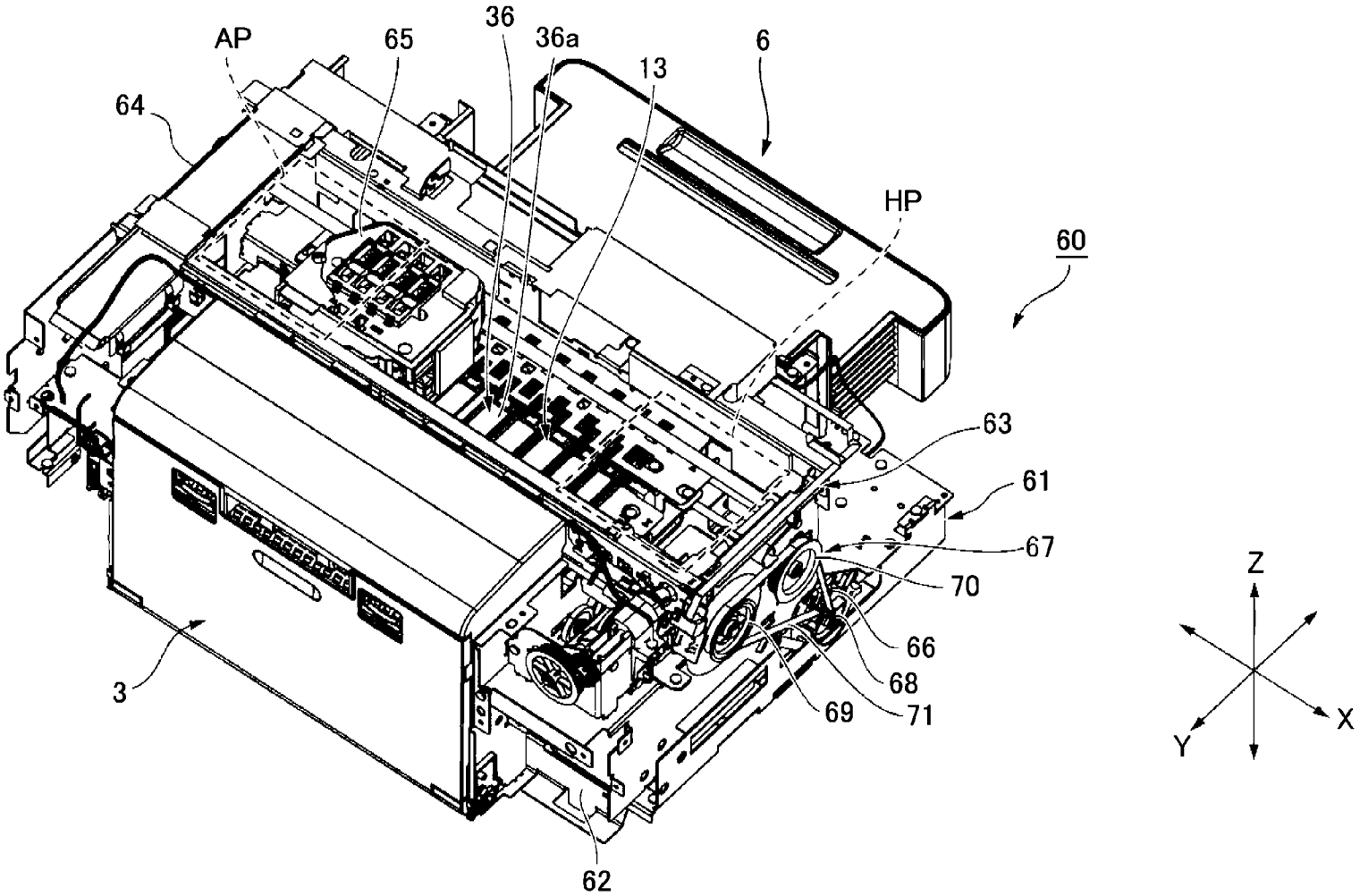
FIG. 9 is an oblique view of the print mechanism unit and inverting unit of the printer.

FIG. 9 is an oblique view showing the inverting unit 3 and the internal print mechanism unit of the printer with the printer case 2A removed from the main unit 2.

The print mechanism unit 60 has a sheet metal main frame 61 with various components assembled on the main frame 61. The main frame 61 includes abase frame 62, and side frames 63, 64 rising perpendicularly to the base frame 62 from positions on the opposite sides of the transverse axis X.

Two carriage guide rails extend parallel to the transverse axis X between the top end parts of the side frames 63, 64 on the vertical axis Z, and a carriage 65 is disposed between the carriage guide rails. The carriage 65 is connected to a timing belt extending on the transverse axis X, and when the timing belt is driven by a carriage drive motor, the carriage 65 slides on the transverse axis X along the carriage guide rails.

The printhead 33 (FIG. 4) is mounted on the carriage 65, and the platen 36 is disposed below the printhead 33. The platen 36 is a segmented platen having a plurality of platen segments 36*a* aligned across the transverse axis X, which is the direction in which the printhead 33 travels. The printhead 33 can move on the carriage 65 between a home position HP at the side frame 63 on one side, and an away position AP at the side frame 64 on the other side. More specifically, the printhead 33 can move bidirectionally widthwise to the main conveyance path 13 between the side frames 63, 64.

Roller Drive Mechanism

As shown in FIG. 9, a paper feed motor 66, and a power transfer mechanism 67 that transfers rotation of the paper feed motor 66 drive shaft to the main conveyance roller pair 32 and first discharge roller pair 34, are disposed to the side of the one side frame 63 facing the outside on the transverse axis X. The main conveyance roller pair 32 and first discharge roller pair 34 are disposed to the main conveyance path 13 on the upstream and downstream sides of the platen 36 (see FIG. 4). The power transfer mechanism 67 includes a pinion 68 attached to the distal end of the motor shaft of the paper feed motor 66; a transfer gear 69 fixed to the end of the axle of the drive roller in the main conveyance roller pair 32; a transfer gear 70 fixed to the end of the axle of the drive roller in the first discharge roller pair 34; and a timing belt 71 mounted on the pinion 68, transfer gear 69, and transfer gear 70.

Rotation from the paper feed motor 66 is transferred from the pinion 68 through the timing belt 71 to the transfer gears 69, 70, the drive roller of the main conveyance roller pair 32, and the drive roller of the first discharge roller pair 34. The main conveyance roller pair 32 and first discharge roller pair 34 are driven synchronously in the same direction at the same peripheral velocity, and convey the paper P through the main conveyance path 13.

In this example, the drive power that rotationally drives the middle conveyance roller 22, which is the drive roller of the middle conveyance roller pair 25, is acquired from the paper feed motor 66 and power transfer mechanism 67. The middle conveyance roller 22 conveys the paper P in the direction to the main conveyance path 13 side. So that only torque rotating the middle conveyance roller 22 in the direction conveying the paper P to the main conveyance path 13 side is transferred through the paper feed motor 66 and power transfer mechanism 67, a one-way clutch or other type of unidirectional torque transfer mechanism is included in the torque transfer path.

Configuration of the Supply Path and Middle Conveyance Path

The specific configuration of the supply path 12 and the middle conveyance path 17 are described below with reference to FIG. 5 and FIG. 7.

The supply path 12 and middle conveyance path 17 portions of the paper P conveyance path are defined by the curved roller surface 22*a* of the middle conveyance roller 22, which is the drive roller in the middle conveyance roller pair 25. More specifically, the supply path portion of the supply path 12 from the supply path 12 to the nipping portion 23*a* of the middle conveyance roller 22 and retard roller 23 is defined by the conveyance guide surface of the roller surface 22*a*. In the middle conveyance path 17, the conveyance path portion from the junction 15 past the nipping portion 25*a* to the path switching unit 16 is formed by the conveyance guide surface of the roller surface 22*a*.

The roller surface 22*a* of the middle conveyance roller 22 therefore functions as one conveyance guide surface of the supply path 12, and as one conveyance guide surface defining the middle conveyance path 17. Because there is no need to form these conveyance path portions by providing separate paper guide surfaces, these conveyance path portions can be configured compactly with few parts.

On the middle conveyance path 17, the conveyance path from the junction 15 to the nipping portion 25*a* is formed by the roller surface 22*a*. Because the junction 15 can be located closer to the nipping portion 25*a* than when separate paper guide members are disposed to form the conveyance path past the junction 15, the conveyance distance from the junction 15 to the nipping portion 25*a* can be shortened. Furthermore, because the junction 15 is located above the roller surface 22*a*, the paper P fed to the junction 15 contacts the roller surface 22*a* of the middle conveyance roller 22. Conveyance force is therefore applied to the paper P by the middle conveyance roller 22, and the paper P is conveyed with good precision from the junction 15 past the nipping portion 25*a* to the path switching unit 16.

Path Switching Unit Configuration

Figure 10:
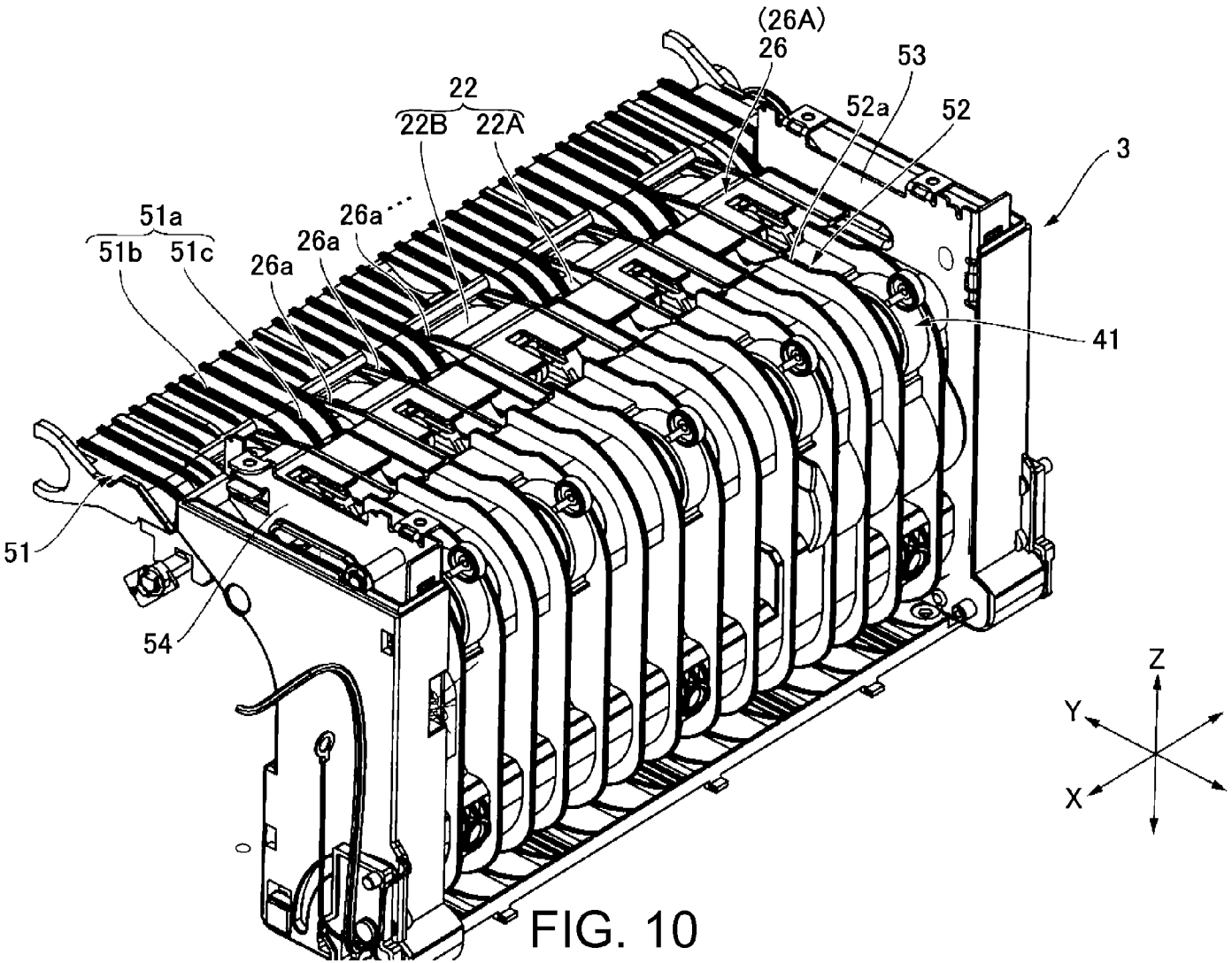
FIG. 10 is an oblique view of the path switching unit and inverting unit of the printer.
Figure 11:
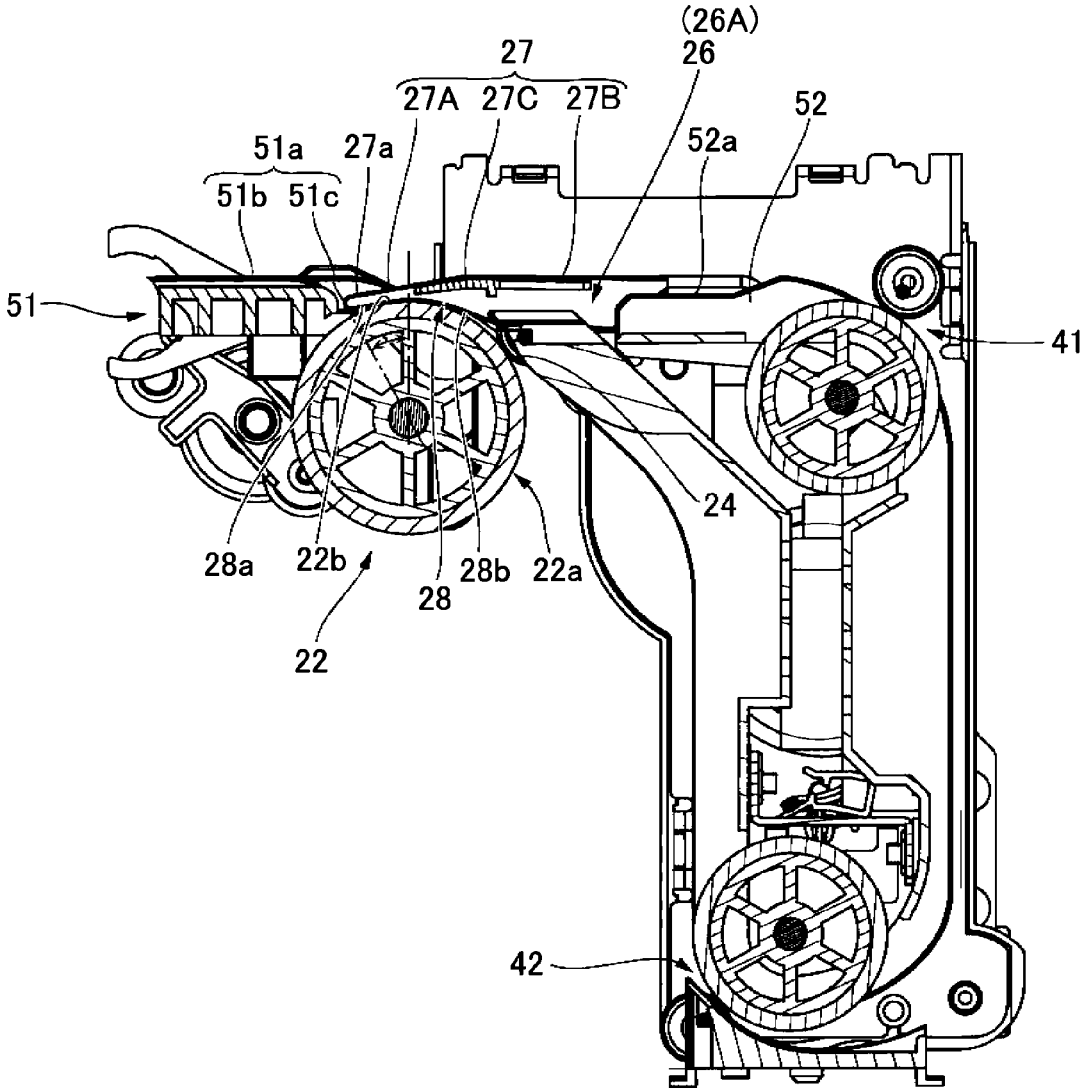
FIG. 11 is a section view of a portion of FIG. 10.
Figure 12:
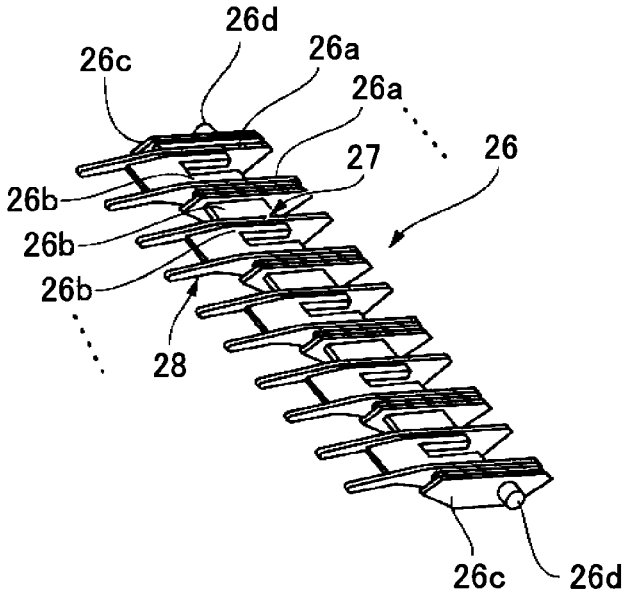
FIG. 12 is an oblique view of the diverter.

To illustrate the lower conveyance path portion of the path switching unit 16, FIG. 10 is an oblique view and FIG. 11 is a section view of the main unit 2 and inverting unit 3 in this area. FIG. 12 is an oblique view of the flap 26. The configuration of the path switching unit 16 where the flap 26 is disposed is described with reference to these figures.

The path switching unit 16 is located between the upstream end of the main conveyance path 13 and the upstream end of the inverting path 14. As shown in FIG. 10 and FIG. 11, the upstream end part of the main conveyance path 13 is defined by the main conveyance path guide surface 51*a* (conveyance guide surface) formed on the top of the conveyance guide 51. The upstream end part of the inverting path 14 is defined by the inverting path guide surface 52*a* of the conveyance guide 52 that defines the bottom conveyance surface of the top path 37. As will be understood from FIG. 11, the flap 26 is disposed between the main conveyance path guide surface 51*a* and the inverting path guide surface 52*a* on the longitudinal axis Y when set to the first switching position 26A.

The flap 26, which is a path switching unit member, is held in the first switching position 26A proximally to the roller surface 22*a* as described above, is pushed by the paper P conveyed by the middle conveyance roller pair 25 toward the junction 15, and can move up and away from the roller surface 22*a* to the second switching position 26B. The flap 26 also has a first guide surface 27 formed on a first side on the opposite side as the roller surface 22*a* (the side facing away from the roller surface 22*a*, and toward the top of the printer in this example), and a second guide surface 28 formed on the second side facing the roller surface 22*a*.

As shown in FIG. 12, the flap 26 is a ribbed diverter having multiple flat longitudinal ribs 26*a* disposed at a regular interval widthwise to the conveyance path in the path switching unit 16, and connectors 26*b* joining adjacent longitudinal ribs 26*a*. An end plate 26*c* is formed integrally to the outside of the longitudinal ribs 26*a* at the opposite ends, and coaxial round pins 26*d* protrude to the outside from the outside surfaces of the end plates 26*c*. The pins 26*d* are pivotably supported by the left and right unit frame side walls 53, 54 of the inverting unit 3 shown in FIG. 10.

The flap 26 is formed so that its center of gravity is closer to the front of the printer than the pins 26*d* (e.g. the center gravity of the flap 26 is in front of the pins 26*d*). The flap 26 therefore pivots on the pins 26*d* so that the front end of the flap 26 descends by its own weight. Basically, flap 26 is biased toward middle conveyance roller 22, and preferably flap 26 is a passive flap, i.e. it does not require electrical power to alter its position and divert paper P along its correct conveyance path. When the flap 26 pivots down, the opposite end plates 26*c* rest on the inverting unit 3 at the opposite sides (not shown in the figure) on the transverse axis X. As a result, the flap 26 is supported in the first switching position 26A by end plates 26*c*. As shown in FIG. 11, when in the first switching position 26A, the second guide surface 28 of the flap 26 is position above, and preferably follows the curvature of, the roller surface 22*a* with a slight gap therebetween.

The first guide surface 27 of the ribbed flap 26 is defined by the top narrow edges of the individual longitudinal ribs 26*a*, and the second guide surface 28 is defined by the narrow bottom edges. As a result, the contact area between the paper P and the first and second guide surfaces 27, 28 of the flap 26 can therefore be reduced, and the friction resistance (conveyance load) on the paper P can be reduced. The paper P sticking to the first and second guide surfaces 27, 28 of the flap 26 by static electricity, and conveyance problems such as the paper P becoming jammed can be prevented or suppressed. More specifically, after one side is printed, the stiffness (rigidity) of the paper P fed from the main conveyance path 13 to the inverting path 14 is lower than before printing, and when the paper P is fed along the first guide surface 27 of the flap 26 to the inverting path 14, paper jams can occur easily if the friction resistance with the first guide surface 27 is high. By using a ribbed flap 26 with a small contact area, such conveyance problems can be reduced or suppressed.

As shown in FIG. 10, the middle conveyance roller 22 includes a roller shaft 22A extending on the transverse axis X, and multiple roller segments 22B of a specific width fixed coaxially to the roller shaft 22A with a specific gap therebetween. In this example, the longitudinal ribs 26*a* are positioned so that the roller segments 22B are located between adjacent longitudinal ribs 26*a* of the ribbed flap 26. The downstream part (the part toward the front of the printer) of the main conveyance path guide surface 51*a* is a flat guide surface 51*b* defined by the flat rib surface, and the upstream part is a curved guide surface 51*c* defined by the curved rib surface curving convexly down between the roller segments 22B. The curved guide surfaces 51*c* and the top first guide surfaces 27 of the flap 26 therefore alternate across the width of the printer.

The relative positions of the flap 26, the roller surface 22*a* of the middle conveyance roller 22, and the main conveyance path guide surface 51*a* are described next with reference mainly to FIG. 11.

As shown in the figure, the middle conveyance roller 22 is located below the main conveyance path guide surface 51*a* and the second guide surface 28 of the flap 26. The roller surface 22*a* of the middle conveyance roller 22 has an outside surface portion 22*b* (the portion of a specific angular range indicated by the arrow in FIG. 11) that curves to the downstream side of the main conveyance path 13 (toward the front of the printer) in the direction separating from the main conveyance path guide surface 51*a*, which in this example is the direction diverging down. More specifically, the middle conveyance roller 22 has an outside surface portion 22*b* that descends gradually to the main conveyance path 13 side from the highest point on the vertical axis Z.

The flap 26 is positioned so that when in the first switching position 26A, the distal end portion of the second guide surface 28*a* on the main conveyance path 13 side of the second guide surface 28 is above the outside surface portion 22*b* of the middle conveyance roller 22 with a slight gap therebetween. The distal end portion of the first guide surface 27*a* on the main conveyance path 13 side of the opposite first guide surface 27 is below the flat guide surface 51*b* of the main conveyance path guide surface 51*a* on the roller surface 22*a* side.

Paper P fed through the middle conveyance path 17 from the junction 15 to the path switching unit 16 is conveyed along the roller surface 22*a* and hits the second guide surface 28 of the flap 26, then pushes the flap 26 up to the second switching position 26B, passes between the second guide surface 28 and the roller surface 22*a*, and is guided by the main conveyance path guide surface 51*a*. More specifically, because the longitudinal ribs 26*a* of the flap 26 and the curved guide surfaces 51*c* of the main conveyance path guide surface 51*a* alternate across the width (see FIG. 10), part of the leading end of the paper P is guided toward the flat guide surface 51*b* of the main conveyance path guide surface 51*a* while pushing the second guide surface 28 of the flap 26 up. The remaining part of the leading end portion of the paper P travels over the curved guide surface 51*c* of the main conveyance path guide surface 51*a*, and is guided along the curved guide surface 51*c*.

As shown in FIG. 10, the longitudinal ribs 26*a* of the flap 26 that contact the paper P are located on both sides of the roller segments 22B of the middle conveyance roller 22. The second guide surface distal end portion 28*a* of the second guide surface 28 formed on the bottom end surfaces of the longitudinal ribs 26*a* are positioned slightly above the outside surface portion 22*b* of the roller surface 22*a* of the middle conveyance roller 22 as shown in FIG. 11. The paper P is therefore conveyed while being pushed by the second guide surface distal end portion 28*a* of the longitudinal ribs 26*a* to the outside surface portion 22*b* side of the roller segments 22B of the middle conveyance roller 22. The paper P is thus reliably conveyed in the path switching unit 16 by the middle conveyance roller 22 toward the main conveyance path 13.

Shape of the First and Second Guide Surfaces of the Flap

The shape of the first guide surface 27 of the flap 26 is described in detail next with reference mainly to FIG. 11. The first guide surface 27 of the flap 26 includes an upstream end-side first guide surface 27A, middle first guide surface 27C, and a downstream end-side first guide surface 27B. When in the first switching position 26A (see FIG. 6A), the upstream end-side first guide surface 27A is defined by a downward sloping plane (e.g. sloping toward middle conveyance roller 22) and extending from a first guide surface distal end portion 27*a* toward the inverting conveyance path 14 (see FIGS. 4 and 5); the downstream end-side first guide surface 27B is defined by a substantially horizontal plane that extends towards, and selectively connects to, the inverting conveyance path 14; and the middle first guide surface 27C is defined by a convex surface smoothly spanning between the upstream side first guide surface 27A and the downstream side first guide surface 27B.

When in the first switching position 26A (see FIG. 6A), the upstream end-side first guide surface 27A is a guide surface including the first guide surface distal end portion 27*a*, and slopes toward the middle first guide surface 27C at an upward angle away from the roller surface 22*a*. Also when in the first switching position 26A, the downstream end-side first guide surface 27B is a flat surface (i.e. sustainably parallel to the main conveyance path 13) extending from the main conveyance path 13 in the direction directing the paper P toward the inverting path 14. More specifically, as will be understood from FIG. 11, the downstream side first guide surface 27B is positioned on substantially the same plane as the back end portion of the main conveyance path guide surface 51*a* and the inverting path guide surface 52*a*.

As described above, the upstream side first guide surface 27A functions as a paper guide face that guides the paper P fed from the main conveyance path 13, and the downstream side first guide surface 27B functions as a paper guide unit that guides the paper P along the straight conveyance path. Paper P fed from the main conveyance path 13 to the path switching unit 16 is fed from the main conveyance path guide surface 51*a* over the first guide surface 27 of the flap 26 in the first switching position 26A, and is guided by the first guide surface 27 to the inverting path 14. The upstream side first guide surface 27A including the first guide surface distal end portion 27*a* of the first guide surface 27 is located slightly lower than the flat guide surface 51*b* of the main conveyance path guide surface 51*a*. The paper P can therefore move smoothly from the main conveyance path 13 along the curved guide surface 51*c* of the main conveyance path guide surface 51*a* onto the first guide surface of the flap 26. Paper P that has been printed on one side can therefore be prevented or suppressed from jamming in the path switching unit 16.

Figure 13A:
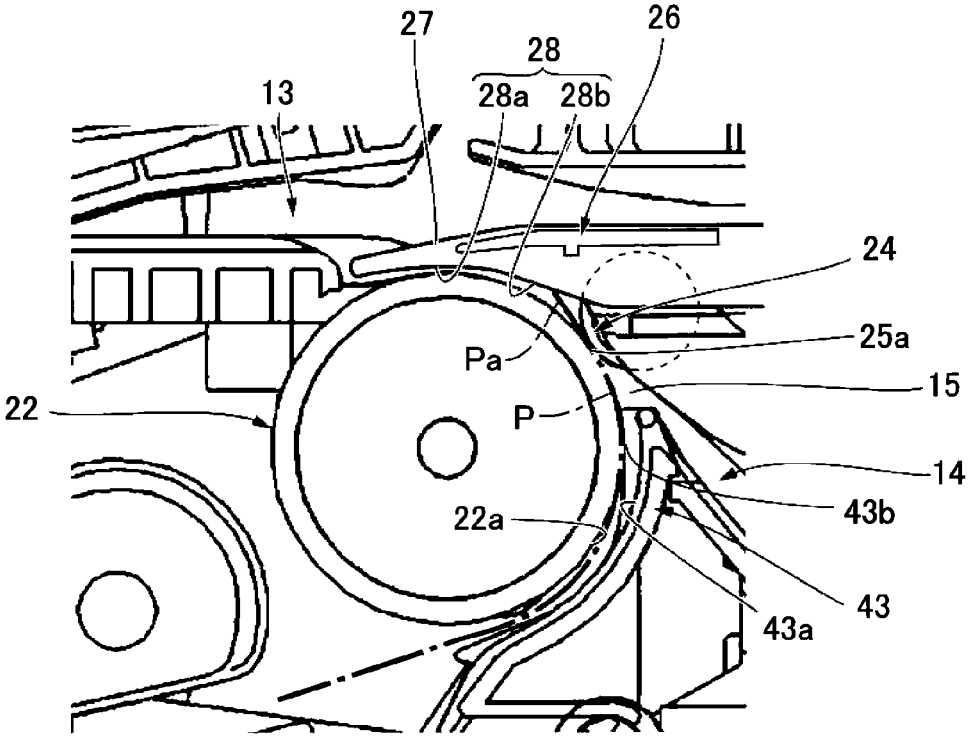
FIGS. 13A, 13B and 13C illustrate the shape and function of the second guide surface of the diverter.
Figure 13B:
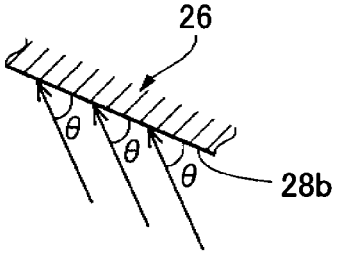
Figure 13C:
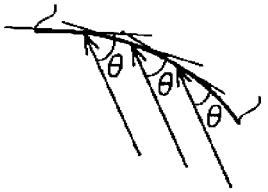

The shape of the second guide surface 28 on the other side of the flap 26 is described next in detail with reference to FIG. 11 and FIGS. 13A, 13B and 13C. FIG. 13A illustrates a situation where the leading end Pa of the paper P strikes the flap 26, and FIG. 13A and FIG. 13C illustrate the function of the second guide surface 28. Note that the leading end of the paper P may contact the flap 26 when the paper P is fed from the supply path 12 through the middle conveyance path 17 to the path switching unit 16, and when the paper P is fed from the inverting path 14 through the middle conveyance path 17 to the path switching unit 16.

The portion of the second guide surface 28 of the flap 26 that the leading end Pa of the paper P fed through the nipping portion 25*a* of the middle conveyance roller pair 25 can strike is a guide surface portion 28*b* defined by a flat surface. The downstream end of the guide surface portion 28*b* communicates smoothly with the second guide surface distal end portion 28*a*, which is defined by a concave curve.

When the leading end Pa of the paper P fed from the middle conveyance path 17 to the path switching unit 16 is curled, then the position where the leading end Pa contacts the guide surface portion 28*b* of the second guide surface 28 changes. However, as shown in FIG. 13*b*, because the guide surface portion 28*b* is a flat surface, the contact angle θ between the leading end Pa and the guide surface portion 28*b* remains substantially constant even when the position where the leading end Pa contacts the guide surface portion 28*b* changes.

However, if the portion of the guide surface that the leading end Pa of the paper P contacts is defined by a curve, as shown in FIG. 13C, the contact angle θ changes greatly according to the point of contact. If the contact angle changes, the force of the paper P pushing the flap 26 up cannot be held constant, and the flap 26 cannot be raised smoothly. As a result, the conveyance load of the flap 26 acting on the conveyed paper also changes, conveyance of the paper becomes unstable, and conveyance problems such as paper jams can occur easily in the path switching unit 16. Because the leading end Pa of the paper P contacts the flap 26 at the guide surface portion 28*b* that is defined by a flat surface in this example, problems such as paper jams caused by change in the force raising the flap can be prevented or suppressed.

OTHER EMBODIMENTS

The invention is described as applied to a printer having an inkjet head as the printhead in the foregoing embodiment. The invention can, however, also be applied to printers that print on both sides of the print medium using a printhead other than an inkjet head. For example, the invention can also be applied to printers that use thermal or dot impact printheads.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a media supply path that conveys a medium to be printed upon;

a first conveyance path that conveys the medium past a print position, the direction of conveying the medium to the printing position for printing being the downstream direction of the first conveyance path;

a looped inverting path that reverses the front and back sides of the medium;

a junction where the downstream end of the media supply path and the downstream end of the inverting path merge;

a second conveyance path extending from the junction to a path switching unit where the upstream end of the first conveyance path and the upstream end of the inverting path merge; and a conveyance roller pair that conveys the medium from the junction toward the path switching unit, the conveyance roller pair having a drive roller and a nipping portion;

wherein the medium is guided by a conveyance roller from the junction to the media nipping portion of the conveyance roller pair, said conveyance roller being the drive roller of the conveyance roller pair;

wherein:

the upstream end of the first conveyance path has a conveyance guide surface that faces the conveyance roller and guides media conveyed by the conveyance roller pair;

the conveyance roller has an outside roller surface that rotates away from the conveyance guide surface in the downstream direction of the first conveyance path; and the path switching unit includes a path switching member having a first member surface on a side facing away from the conveyance roller and a second member surface opposite the first member surface on a side facing the conveyance roller, a first switching-member guide surface being formed on the first member surface and a second switching-member guide surface being formed on the second member surface;

the path switching member being movably switchable between a first switching position and a second switching position, wherein the first switching position guides media, that is conveyed from the first conveyance path to the path switching unit, to the inverting path, and the second switching position guides media, that is conveyed from the second conveyance path to the path switching unit, to the first conveyance path, said path switching member being biased toward said first switching position in a resting state and requiring a pushing force to be moved to said second switching position;

in said first switching position, the second switching-member guide surface being proximate to the conveyance roller and the distal end of the second switching-member guide surface, that is closest to the first conveyance path, facing the outside roller surface of the conveyance roller;

when medium is conveyed to the path switching unit by the conveyance roller pair, the medium pushes on the second switching-member guide surface and pushes the path switching member to said second switching position; and in the second switching position, the second switching-member guide surface being moved away from the conveyance roller, and the distal end of the first switching-member guide surface, that is closest to the first conveyance path, being at a position moved away from the conveyance guide surface of the first conveyance path.

2. The printer described in claim 1, wherein:

the conveyance roller and a media guide opposite the conveyance roller guide the medium along the media supply path to the junction from a position a specific distance upstream from the junction on the media supply path.

3. The printer described in claim 2, wherein:

the media guide has a media pressure surface that presses the medium toward the conveyance roller.

4. The printer described in claim 1, wherein:

the first distal end of the first switching-member guide surface, that is closest to the first conveyance path, being an upstream end-side first guide surface;

the second distal end of the first switching-member guide surface opposite the upstream end-side first guide surface being a downstream end-side first guide surface;

the portion of the first switching-member guide surface between the upstream end-side first guide surface and the downstream end-side first guide surface being a middle first guide surface; and in the first switching position:

the upstream end-side first guide surface is defined by a downward sloping plane that slopes from the middle first guide surface toward conveyance roller, the downstream end-side first guide surface is defined by a substantially horizontal plane that extends in a feed direction of medium conveyed from the first conveyance path toward the inverting path, and the middle first guide surface defined by a curve smoothly connecting the upstream end-side first guide surface to the downstream end-side first guide surface.

5. The printer described in claim 1, wherein media conveyed through the media nipping portion to the path switching unit contacts a flat part of the second switching-member guide surface.

6. The printer described in claim 1, wherein:

the switching member includes a plurality of ribs extending in a first feed direction of medium conveyed from the first conveyance path toward the inverting path, the plurality of ribs being disposed at regular intervals widthwise relative to the first feed direction, the switching member further including connector parts connecting the ribs widthwise; and a top edge of each rib being a respective one of said first member surface, and a bottom edge of each rib being a respective one of said second member surface.

7. The printer described in claim 6, wherein:

the conveyance roller has a roller shaft, and a plurality of roller segments disposed with a specific gap therebetween on the roller shaft; and the ribs are disposed widthwise relative to the conveyance path on both sides of the roller segments.

8. The printer described in claim 1, further comprising:

a media separation mechanism that separates and conveys the media one sheet at a time through the media supply path;

the media separation mechanism including the conveyance roller, and a retard roller configured to contact the conveyance roller.

9. The printer described in claim 1, further comprising:

a main conveyance roller pair that conveys the medium through the first conveyance path;

a power supply that rotationally drives the main conveyance roller pair; and a power transfer mechanism that transfers drive power from the power supply to the conveyance roller to rotationally drive the conveyance roller in the direction conveying the medium to the path switching unit.

10. The printer described in claim 1, wherein path switching member is a flap freely pivotal about a pivot point.

11. The printer described in claim 10, wherein:

said first switching position is the resting state of said flap;

said flap is biased toward said first switching position by gravity; and said second switching position is a displacement position of said flap when pivoted against gravity about said pivot point.

* * * * *